US012042036B1

(12) United States Patent
Lee et al.

(10) Patent No.: US 12,042,036 B1
(45) Date of Patent: Jul. 23, 2024

(54) STICK-TYPE CONTAINER FOR EASY LIFTING OF CONTENTS

(71) Applicant: YONWOO CO., LTD., Incheon (KR)

(72) Inventors: Kang Jin Lee, Incheon (KR); Yu Seob Kim, Incheon (KR); Hyun Kyu Kang, Incheon (KR); Seo Hui Jung, Incheon (KR); Ki Young Ham, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 18/590,484

(22) Filed: Feb. 28, 2024

Related U.S. Application Data

(63) Continuation of application No. PCT/KR2024/000622, filed on Jan. 12, 2024.

(30) Foreign Application Priority Data

Jan. 11, 2024 (KR) ..... 10-2024-0004922

(51) Int. Cl.
*A45D 40/02* (2006.01)
*A45D 40/20* (2006.01)

(52) U.S. Cl.
CPC ..... *A45D 40/02* (2013.01); *A45D 40/023* (2013.01); *A45D 2040/207* (2013.01)

(58) Field of Classification Search
CPC . A45D 40/02; A45D 40/023; A45D 2040/207
USPC ..... 401/55
See application file for complete search history.

(56) References Cited

FOREIGN PATENT DOCUMENTS

| | | | | |
|---|---|---|---|---|
| KR | 20-0487135 | Y1 | | 9/2018 |
| KR | 10-2020-0105082 | A | | 9/2020 |
| KR | 10-2021-0054281 | A | | 5/2021 |
| KR | 20220026341 | A | * | 3/2022 |

* cited by examiner

*Primary Examiner* — Jennifer C Chiang
(74) *Attorney, Agent, or Firm* — Bridgeway IP Law Group, PLLC; Sang Ho Lee; Hyun Woo Shin

(57) ABSTRACT

A stick-type container may include: an outer housing assembly having an exposure opening formed thereon; a button assembly coupled to the outer housing assembly and is slidingly movable in a first direction with respect to the outer housing assembly; and an inner housing accommodated in the outer housing assembly and configured to accommodate a content therein, wherein while the button assembly is slidingly moving, the inner housing moves in a second direction different from the first direction with respect to the outer housing assembly.

19 Claims, 6 Drawing Sheets

300: 301, 302, 303

STICK-TYPE CONTAINER FOR EASY LIFTING OF CONTENTS

CROSS-REFERENCE TO RELATED APPLICATION(S)

The present application is a continuation application of PCT international application No. PCT/KR2024/000622 filed on Jan. 12, 2024, and claims priority to Korean patent application No. 10-2024-0004922 filed on Jan. 11, 2024, the entire contents of which is hereby incorporated by reference herein.

TECHNICAL FIELD

The present invention relates to a stick type container for easy lifting of a content, more specifically to a container that is capable of easily lifting a content by means of a simple sliding movement of a button assembly.

BACKGROUND ART

Recently, a stick type container, which directly applies a content accommodated therein to a desired region without the content coming into contact with a user's hand, has been very popular. Such a stick type container is applied to various products, such as a sun stick, a foundation stick, a serum stick, and the like.

Generally, a conventional stick type container is configured to rotate the content accommodated therein by means of a part such as a dial and move the content to the outside therefrom. However, such a rotary operation requires an excessive force in rotating a portion of the stick type container, and further, many rotations are needed to move the content to the outside of the container by a desired degree. Additionally, a rotational member such as the dial has to be mounted on the container to rotate the content, thereby limiting the shape of the container and freedom of design of the container.

According to the conventional stick type container, further, the content may be unexpectedly exposed to the outside so that it is difficult to control the insertion and exposure of the content, and if a configuration for controlling the rotation of the dial is additionally provided, a member such as a stopper has to be located in a narrow space, thereby undesirably making the configuration more complicated and increasing the number of parts needed, and causing low manufacturing productivity.

DISCLOSURE

Technical Problem

Accordingly, the present invention has been made in view of the above-mentioned problems occurring in the related art, and it is an object of the present invention to provide a stick type container that is capable of easily lifting a content.

The technical problems to be achieved through the present invention are not limited as mentioned above, and other technical problems not mentioned herein will be obviously understood by one of ordinary skill in the art through the following description.

Technical Solution

A container is provided according to an embodiment of the present invention. The container may include: an outer housing assembly having an exposure opening formed thereon; a button assembly coupled to the outer housing assembly in such a way as to be slidingly movable in a first direction with respect to the outer housing assembly; and an inner housing accommodated in the outer housing assembly to accommodate a content therein, wherein while the button assembly is slidingly moving, the inner housing moves in a second direction different from the first direction with respect to the outer housing assembly.

Advantageous Effects of Invention

According to the present invention, the stick type container is configured to easily lift the content by means of the simple sliding movement of the button assembly, thereby advantageously enhancing the conveniences of use. To be more specific, the stick type container according to the present invention can ascend and descend the content through a non-rotary operation, so that it can exposure the content to the outside more easily, without having any excessive force, when compared to the conventional stick type container having a dial adapted to rotate to allow the content to be exposed to the outside.

Further, the stick type container according to the present invention can predict and control a degree of exposure of the content according to a degree of sliding movement of the button assembly.

Furthermore, the stick type container according to the present invention can be simple in configuration and produced with a small number of parts, thereby ensuring high productivity.

Besides, the stick type container according to the present invention is provided with the stopper for limiting the movement of the button. Through the interaction between the stopper and the button, accordingly, the movement of the button is controlled through the simple operation of applying an external force to the button or releasing the external force therefrom. As a result, it is easy to fix the content in position or control the lifting of the content.

BRIEF DESCRIPTION OF DRAWINGS

To allow the drawings as will be mentioned in the description of the present invention to be more sufficiently understood, the brief description of the drawings may be provided.

BEST MODE FOR INVENTION

Figure 1:
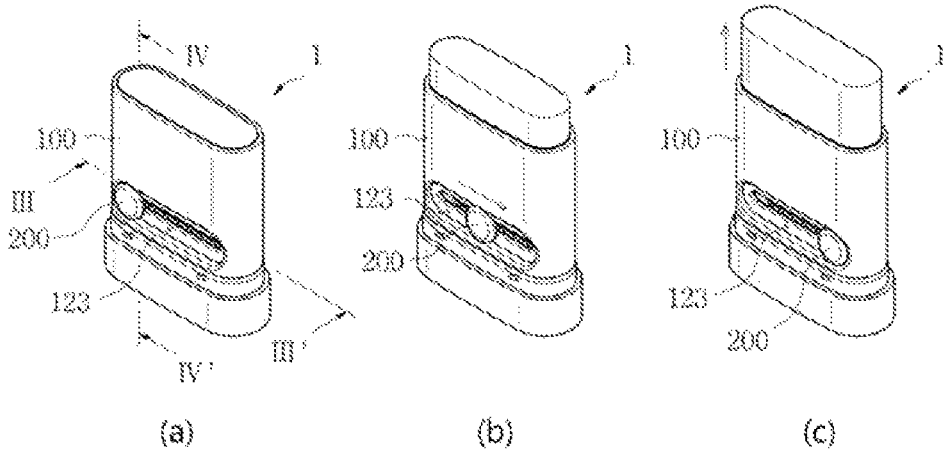
FIG. 1 is a perspective view showing a container according to an embodiment of the present invention.

A container is provided according to an embodiment of the present invention. The container may include: an outer housing assembly having an exposure opening formed thereon; a button assembly coupled to the outer housing assembly and is slidingly movable in a first direction with respect to the outer housing assembly; and an inner housing accommodated in the outer housing assembly and configured to accommodate a content therein, wherein while the button assembly is slidingly moving, the inner housing moves in a second direction different from the first direction with respect to the outer housing assembly.

The button assembly may be movable from an unused position to a used position in the first direction, and while the button assembly moves from the unused position to the used position, the inner housing may move in the second direction from a hidden position within the outer housing assembly towards an exposed position closer to the exposure opening than the hidden position.

The inner housing may include a guide groove accommodating an end portion of the button assembly, and the guide groove may be slantedly defined with respect to the first direction.

A length of the guide groove in the second direction may correspond to a length of the inner housing in the second direction from the hidden position to the exposed position, and when the inner housing is at the exposed position, the length of the guide groove in the second direction may be set to prevent an end portion of the inner housing from being exposed over the exposure opening.

The inner housing may further include: a content accommodation portion corresponding to the exposure opening; and an inner housing neck extending from the content accommodation portion and is in contact with an inner surface of the outer housing assembly.

The outer housing assembly may include an outer housing having a concave portion formed concavely thereon to support the inner housing neck, and the outer housing may guide the movement of the inner housing neck in the second direction.

The concave portion may support the content accommodation portion, when the inner housing is at the hidden position.

The outer housing may include a guide hole extending in the first direction, and the guide hole may be configured to have the button assembly inserted therein, and may guide the movement of the button assembly in the first direction.

The outer housing assembly may further include a cover member, and the cover member may be configured to have the button assembly inserted therein and may have a sliding hole corresponding to the guide hole.

The button assembly may include a button, and the button may include: a button head exposed to an outside of the outer housing assembly; and a button neck inserted into the outer housing assembly.

When the button is at a limitation position, the button may be fixed to the cover member of the outer housing assembly and may be limited in the movement in the first direction, and when the button is in a a limitation releasing position, the button may be movable in the first direction, and the limitation releasing position may be located more inwardly from the outer housing assembly than the limitation position.

The cover member may include a stopper having a plurality of teeth arranged in the first direction of the sliding hole, and the button may further include a stop protrusion extending from the button neck toward the plurality of teeth, and when the button is at the limitation position, the stop protrusion may be located between a pair of neighboring teeth of the plurality of teeth to limit the movement of the button, and when the button is at the limitation releasing position, the stop protrusion may be separated from the plurality of teeth and the button may be movable in the first direction.

The button assembly may further include an elastic member fixed to the button to elastically bias the button to the limitation position when the button is at the limitation releasing position.

The elastic member may include a base part fixed between the cover member and the concave portion and having the button neck pass therethrough, a fixed part fixed to the button neck and having the button neck pass therethrough, and an elastic part disposed on an outside of the button neck and configured to connect the base part and the fixed part.

The button neck may include a fixing groove concaved inwardly therefrom to accommodate the fixed part of the elastic member.

The outer housing may include a bottom opening formed on an opposite side to the exposure opening and the outer housing assembly may further include a bottom cap configured to cover the bottom opening.

A container according to another embodiment of the present invention may include: an outer housing assembly comprising a sliding hole extending in a first direction and a stopper with a plurality of teeth arranged in the first direction of the sliding hole; a button inserted into the sliding hole and is slidingly movable in the first direction with respect to the outer housing assembly, and the button may include a stop protrusion extending therefrom and may be located between a pair of neighboring teeth of the plurality of teeth; and an inner housing accommodated in the outer housing assembly and is slidingly movable in a second direction different from the first direction when the button moves in the first direction, and when the button is at a limitation position where the stop protrusion is located between the pair of neighboring teeth, the button is limited in movement, and when the button is at a limitation releasing position where the stop protrusion is separated from the plurality of teeth, the button is movable in the first direction.

The button may further include an elastic member fixed thereto, and when the button is at the limitation releasing position, the elastic member may elastically bias the button to the limitation position.

The elastic member may include a base part fixed to the outer housing assembly, a fixed part fixed to the button, and an elastic part for connecting the base part and the fixed part.

MODE FOR INVENTION

Hereinafter, example embodiments will be described with reference to the accompanying drawings. In addition, a device of the present invention and a method for using the device will be explained in detail with reference to the attached drawings. In the drawings, the same reference numerals or symbols are parts or components performing the same functions. Further, top, bottom, left and right directions as will be described below are determined with reference to the drawings, and accordingly, the scope of the present invention is not necessarily restricted to the corresponding directions.

Terms, such as the first, the second, and the like, may be used to describe various elements, but the elements should not be restricted by the terms. The terms are used to only distinguish one element from the other element. For example, a first element may be named a second element without departing from the scope of the present invention. Likewise, a second element may be named a first element.

A term 'and/or' includes a combination of a plurality of relevant and described items or any one of a plurality of related and described items.

Terms used in this application are used to only describe specific exemplary embodiments and are not intended to restrict the present invention. An expression referencing a singular value additionally refers to a corresponding expression of the plural number, unless explicitly limited otherwise by the context. In this application, terms, such as "comprise", "include", or 'have", are intended to designate those characteristics, numbers, steps, operations, elements, or parts which are described in the specification, or any combination of them that exist, and it should be understood that they do not preclude the possibility of the existence or possible addition of one or more additional characteristics, numbers, steps, operations, elements, or parts, or combinations thereof.

In the description, when it is said that one element is described as being "connected" to the other element, one element may be directly connected or coupled to the other element, but it should be understood that another element may be present between the two elements. When it is said that one portion is described as "includes" any component, further, one element may further include other components unless no specific description is suggested.

Figure 2:
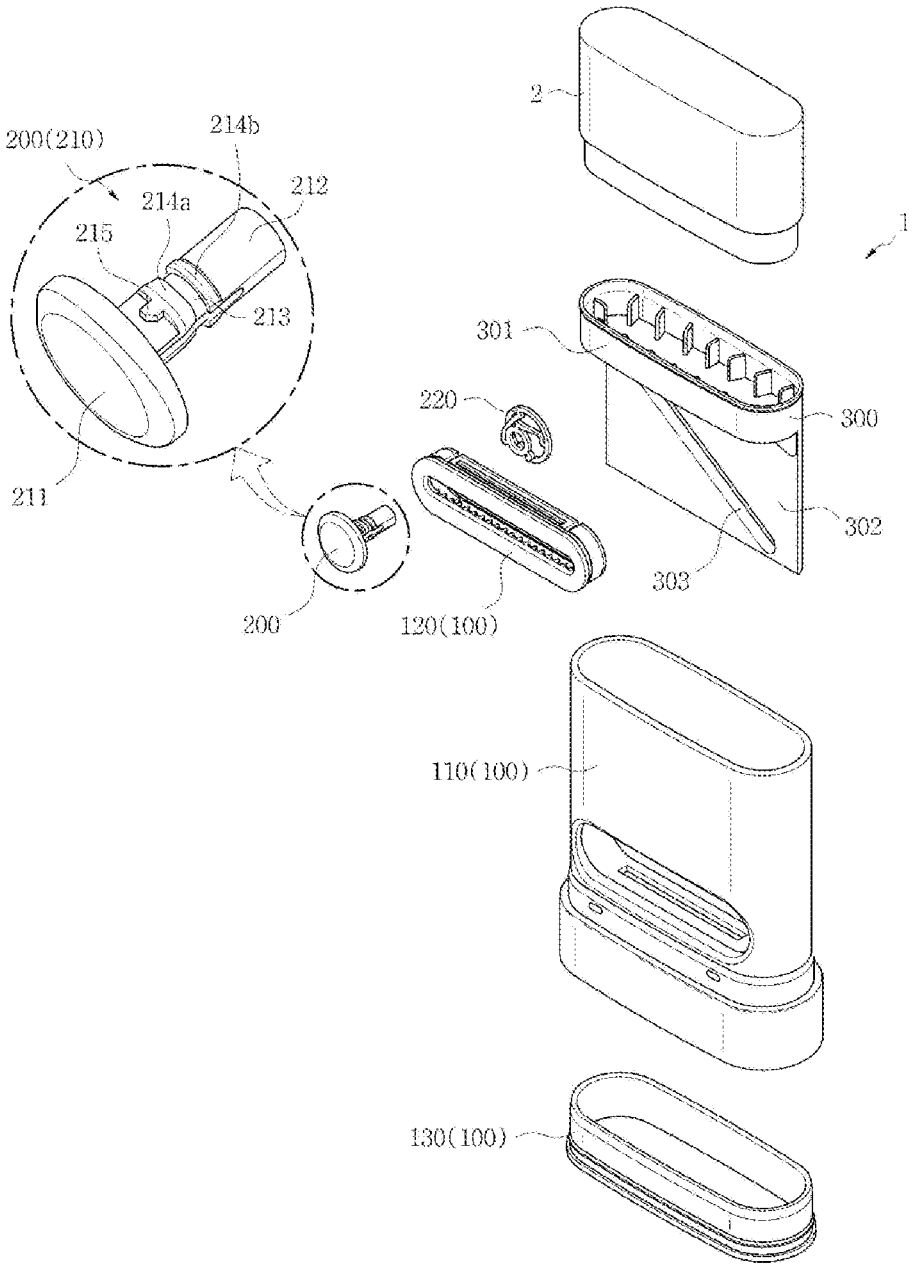
FIG. 2 is an exploded perspective view showing the container according to the embodiment of the present invention.

FIG. 1 is a perspective view showing a container 1 according to an embodiment of the present invention. As the container 1 is changed from a position of FIG. 1 (*a*) to a position of FIG. 1(*c*), the content 2 of the container 1 becomes gradually exposed to the outside so that it can be easy to be used by a user. FIG. 2 is an exploded perspective view showing the container according to the embodiment of the present invention. An enlarged portion in FIG. 2 represents a button 210 of a button assembly 200.

Referring to FIGS. 1 and 2, an explanation of the container 1 according to the embodiment of the present invention will be given schematically.

As shown in FIG. 1, the container 1 is configured to move the content 2 so that the content 2 is exposed to the outside. In this case, the content 2 may be a solid cosmetic material having a given outer shape. For example, the content 2 may represent a sun stick, a foundation stick, a cheek stick, etc. Accordingly, the container 1 represents a cosmetic container. Without being limited thereto, however, the content 2 may be something having a given outer shape and the container 1 may be something for accommodating the content 2 therein.

The container 1 has an outer housing assembly 100 for defining the outer shape thereof. The outer housing assembly 100 is constituted of a plurality of parts, as defined as the term, assembly, and otherwise, the outer housing assembly 100 may be a single unitary part, irrespective of the term, assembly as defined. Hereinafter, the embodiment of the present invention wherein the outer housing assembly 100 is constituted of a plurality of parts will be explained.

The outer housing assembly 100 is configured to accommodate the content 2. In this case, the outer housing assembly 100 has an exposure opening 111 for exposing the content 2 to the outside (See FIG. 3). The exposure opening 111 is formed on top of the outer housing assembly 100 as shown in FIG. 1.

The container 1 includes the button assembly 200 configured to be controlled by a user. The button assembly 200 is coupled to the outer housing assembly 100 in such a way as to be movable with respect to the outer housing assembly 100. To be more specific, the outer housing assembly 100 has a sliding hole 123 extending in a first direction in such a way as to allow the button assembly 200 to move therealong. In this case, the button assembly 200 slidingly moves in the first direction with respect to the outer housing assembly 100. As shown in FIG. 1, the first direction is a left and right direction. However, the first direction may not be limited thereto. For example, the first direction may be a slant direction to a given angle with respect to the left and right direction, and otherwise, the first direction may be an arbitrary direction. Hereinafter, the embodiment of the present invention wherein the first direction is the left and right direction will be explained.

As the button assembly 200 moves in the first direction, that is, from left to right, as shown in FIG. 1, the content 2 is slidingly movable in a second direction different from the first direction, that is, from bottom to top, as shown in FIG. 1. In this case, the second direction is an upward and downward direction. However, the second direction may not be limited thereto. For example, the second direction may be a direction having a given angle with respect to the upward and downward direction, and otherwise, the second direction may be an arbitrary direction. Hereinafter, the embodiment of the present invention wherein the second direction is the upward and downward direction will be explained.

The container 1 according to the embodiment of the present invention is configured to rotatingly move along a rotary shaft parallel to an extending direction of the content 2, so that it does not move the content 2. Accordingly, an excessive motion for the rotational movement is prevented from occurring. Further, a configuration for slidingly moving the button assembly 200 provides an aesthetic feeling different from the configuration where the container rotates to move the content. Furthermore, a degree of sliding movement of the button assembly 200 matches a degree of the content 2 drawn from the container 1, so that a degree of exposure of the content 2 can be easily predicted.

Further, as shown in FIG. 2, the container 1 includes an inner housing 300 configured to fix the content 2. The inner housing 300 is movable with respect to the outer housing assembly 100. Accordingly, the movement of the content 2 with respect to the outer housing assembly 100 is performed by the movement of the inner housing 300 with respect to the outer housing assembly 100. That is, the inner housing 300 is accommodated in the outer housing assembly 100 in such a way as to be slidingly movable in the second direction different from the first direction with respect to the outer housing assembly 100.

Further, the inner housing 300 has a content accommodation portion 301 on which the content 2 is mounted. Furthermore, the inner housing 300 has an inner housing neck 302 extending from the content accommodation portion 301. The content accommodation portion 301 has the shape corresponding to the shape of the content 2. For example, as shown in FIG. 1, if the content 2 has the sectional shape of a pillar similar to an oval, the content accommodation portion 301 has the shape similar to the oval. The inner housing neck 302 is smaller in sectional area than the content accommodation portion 301 in such a way as to extend toward a direction distant from a portion where the content 2 is inserted. For example, as shown in FIG. 2, the inner housing neck 302 extends downward from the content accommodation portion 301.

In this case, the inner housing 300 has a guide groove 303. To be more specific, the guide groove 303 is formed on the inner housing neck 302. In this case, the guide groove 303 may be a hole, even though it is defined as a groove. However, the embodiment of the present invention wherein the guide groove 303 is defined as a groove will be described. The guide groove 303 interacts with the button assembly 200 so that as the button assembly 200 moves, the inner housing 300 moves in the different direction from the moving direction of the button assembly 200. The operation will be explained in detail later with reference to FIG. 3.

The outer housing assembly 100 includes an outer housing 110 configured to accommodate the inner housing 300. The outer housing 110 has the above-mentioned exposure opening 111 formed on one side thereof. The outer housing 110 has a bottom opening 112 formed on the other side thereof (See FIG. 3). Further, the outer housing 110 has the shape capable of accommodating the content accommodation portion 301 of the inner housing 300. For example, the outer housing 110 has the shape of a pillar with the sectional shape of an oval, and in this case, the pillar is open on top and bottom and just has the outer peripheral surface thereof.

The outer housing assembly 100 includes a bottom cap 130 coupled to the outer housing 110 to cover the bottom opening 112 formed on the opposite side to the exposure opening 111 of the outer housing 110.

The outer housing assembly 100 includes a cover member 120 adapted to insert the button assembly 200. The cover member 120 is coupled to the outer housing 110. The above-mentioned sliding hole 123 may be formed on the cover member 120.

The button assembly 200 includes the button 210 inserted into the outer housing assembly 100 in such a way as to be controlled by the user and an elastic member 220 adapted to apply an elastic force to the button 210.

As shown by the enlarged portion of FIG. 2, the button 210 has a button head 211 exposed to the outside of the outer housing assembly 100 and/or a button neck 212 inserted into the outer housing assembly 100. The button neck 212 has a fixing groove 213 concave therefrom. The fixing groove 213 serves to fix the elastic member 220 to the button 210. The button neck 212 includes a first protrusion 214*a* protruding therefrom in a radial direction thereof in such a way as to be located close to the fixing groove 213 and/or a second protrusion 214*b* protruding therefrom in the radial direction thereof in such a way as to be located close to the first protrusion 214*a*, while the fixing groove 213 is being placed therebetween, so that the fixing groove 213 has a given depth. The button 210 has a stop protrusion 215 protruding from the button neck 212 toward the button head 211. To be more specific, the stop protrusion 215 protrudes from the first protrusion 214*a* toward the button head 211. The stop protrusion 215 interacts with a stopper 121 as will be discussed later (See FIG. 5) to limit the movement of the button 210. The operation will be explained in detail later.

Hereinafter, an operation of the container 1 according to the present invention will be explained in detail, and a specific configuration not explained yet will be described.

Figure 3:
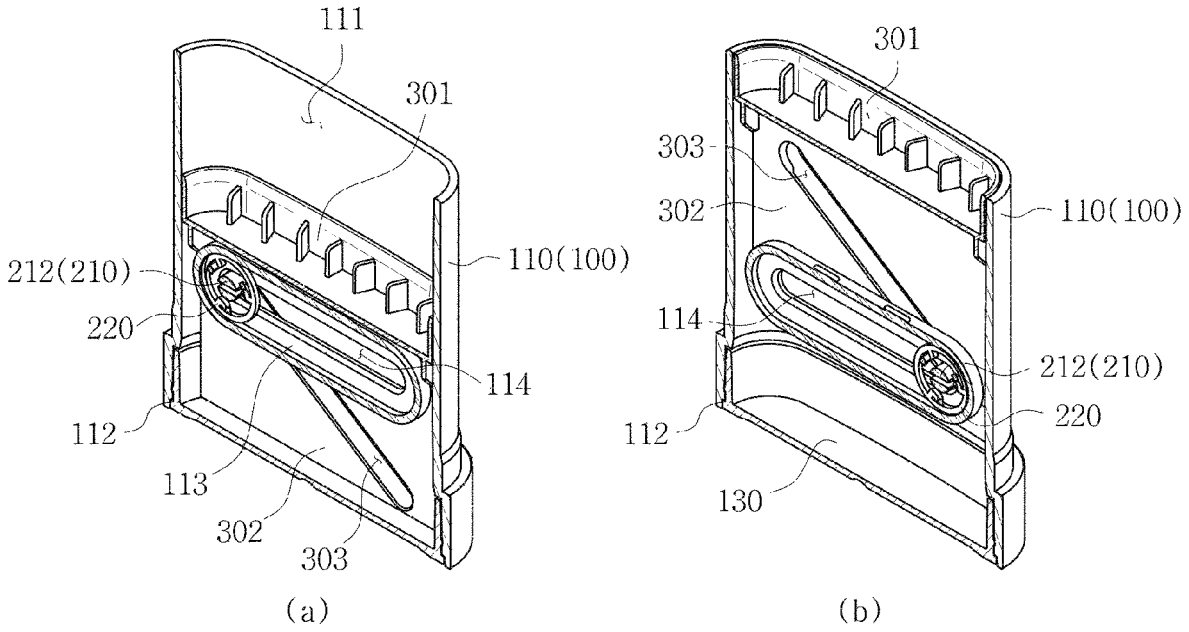
FIG. 3 is a sectional view taken along the line III-III' of FIG. 1.
Figure 4:
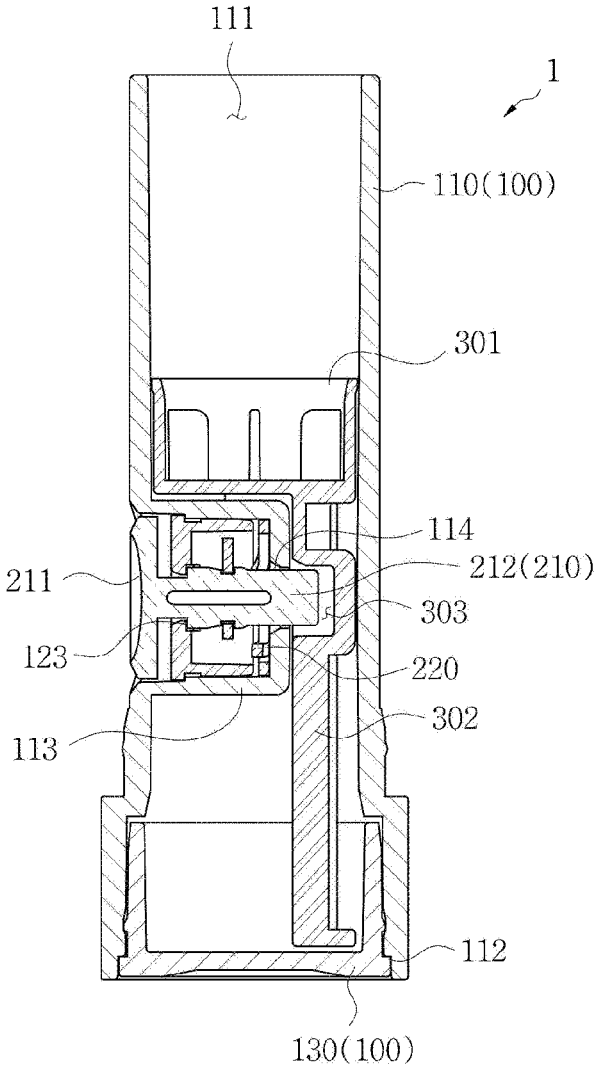
FIG. 4 is a sectional view taken along the line IV-IV' of FIG. 1.

FIG. 3 is a sectional view taken along the line III-III' of FIG. 1. FIG. 3(*a*) shows a state where the inner housing 300 is located at a hidden position, while the button assembly 200 is being located at an unused position, and FIG. 3(*b*) shows a state where the inner housing 300 is located at an exposed position, while the button assembly 200 is being located at a used position. FIG. 4 is a sectional view taken along the line IV-IV' of FIG. 1.

Now, the container 1 according to the embodiment of the present invention will be explained in detail with respect to FIGS. 3 and 4, As mentioned above, the inner housing 300 is accommodated in the outer housing 110 in such a way as to be movable with respect to the outer housing 110. In this case, the movement of the inner housing 300 represents the movement of the content 2. The movement of the inner housing 300 is performed by the movement of the button assembly 200.

In this case, the inner housing 300 is supported against the button assembly 200. To be more specific, the button neck 212 of the button 210 is accommodated in the guide groove 303 formed on the inner housing 300, and a portion of the inner housing 300, that forms the guide groove 303, is supported against the end portion of the button neck 212. As shown in FIG. 3, the inner housing 300 is pressurized against the button assembly 200, while the button assembly 200 is moving, and thus moves toward the exposure opening 111.

That is, the button assembly 200 is movable from the unused position to the used position moving to the first direction from the unused position. The unused position of the button assembly 200 corresponds to the position of FIG. 3(*a*), and the used position of the button assembly 200 to the position of FIG. 3(*b*). While the button assembly 200 is moving from the unused position to the used position thereof, the inner housing 300 moves from the hidden position where it is accommodated in the outer housing assembly 100 to the exposed position closer to the exposure opening 111 in the second direction than the hidden position. In this case, the hidden position of the inner housing 300 corresponds to the position of FIG. 3(*a*), and the exposed position of the inner housing 300 to the position of FIG. 3(*b*). While the button assembly 200 is moving from left to right, as shown in FIG. 3, the inner housing 300 is movable from bottom to top according to the movement of the button assembly 200.

In this case, the guide groove 303 accommodates the end portion of the button assembly 200 thereinto. As the button assembly 200 moves in the first direction from the unused position to the used position, the guide groove 303 becomes slant toward the second direction from the exposed position to the hidden position. For example, as shown in FIG. 3, the guide groove 303 becomes slant toward the right side in such a way as to extend downward. As the button assembly 200 moves to the right, accordingly, the inner housing 300 supported against the button assembly 200 receives an upward force from the button assembly 200 along the extending direction of the guide groove 303 and thus moves upward. While the button assembly 200 is at the unused position, as shown in FIG. 3, the end portion of the button neck 212 is located close to the top left of the guide groove 303, and while the button assembly 200 is being at the used position, the end portion of the button neck 212 is located close to the bottom right of the guide groove 303.

In this case, a length of the guide groove 303 in the second direction corresponds to a length of the inner housing 300 in the second direction from the hidden position to the exposed position thereof. Further, the length of the guide groove 303 in the second direction is set to prevent the end portion of the inner housing 300 from being exposed over the exposure opening 111, while the inner housing 300 is being at the exposed position. That is, as shown in FIG. 3, the inner housing 300 moves in the upward and downward direction in such a way as to correspond to the upward and downward length of the guide groove 303, and accordingly, the length of the guide groove 303 is appropriately adjusted, so that even in the case where the inner housing 300 moves upward to the maximum, the outer housing 110 is prevented from being exposed to the outside.

In this case, the movement of the inner housing 300 is guided by means of the outer housing 110. As mentioned above, the inner housing 300 includes the content accommodation portion 301 corresponding to the exposure opening and/or the inner housing neck 302 extending from the content accommodation portion 301. As shown in FIG. 4, the inner housing neck 302 of the inner housing 300 is brought into contact with the inner surface of the outer housing assembly 100. To be more specific, the outer housing 110 has a concave portion 113 formed concavely thereon to support the inner housing neck 302, so that the outer housing 110 serves to guide the movement of the inner housing neck 302 in the second direction. The concave portion 113 serves to support the content accommodation portion 301, while the inner housing 300 is moving from the hidden position to the exposed position. For example, as shown in FIG. 4, the left and right sides of the inner housing neck 302 are supported against the concave portion 113 of the outer housing 110 and the right inner wall of the outer housing 110, and while the inner housing 300 is moving up and down, accordingly, the inner housing neck 302 is prevented from moving to the left and right. Further, as a portion of the outer housing 110 is concave to form the concave portion 113, a concave space portion defined by the concave portion 113 is formed when the concave portion 113 is viewed on the outside of the outer housing 110.

In this case, as shown in FIG. 3, the outer housing 110 includes a guide hole 114 extending in the first direction, inserting the button assembly 200, and guiding the movement of the button assembly 200 in the first direction. The guide hole 114 is formed on the side of the concave portion 113 toward the inner housing 300. To be more specific, as shown in FIG. 4, the button neck 212 of the button 210 passes through the guide hole 114. The movement of the button assembly 200 excepting the movement in the first direction thereof is limited by means of the guide hole 114, and accordingly, the movement of the button assembly 200 in the predetermined direction is guided smoothly.

As mentioned above, the outer housing assembly 100 includes the cover member 120 for covering the concave portion 113. To be more specific, the cover member 120 serves to cover the concave space portion formed by the concave portion 113. A portion of the button neck 212 and the elastic member 220 are accommodated in the concave space portion formed by the concave portion 113. At least a portion of the cover member 120 is insertedly coupled to the concave portion 113. The cover member 120 has the sliding hole 123 corresponding to the guide hole 114 in such a way as to insert the button assembly 200. That is, the sliding hole 123 extends in the first direction. To be more specific, the sliding hole 123 is formed on a given portion of the cover member 120 for covering the concave space portion formed by the concave portion 113. The button neck 212 is inserted into the sliding hole 123 and/or the guide hole 114, and accordingly, the movement of the button neck 212 in the first direction is stably guided along the sliding hole 123 and/or the guide hole 114.

Up to now, the movement of the content 2 according to the movement of the button assembly 200 has been explained. Now, a configuration where the content 2 is fixed after moving will be described. If the content 2 is exposed to the outside even when the user does not want to expose the content 2, the exposed content 2 may be applied to an undesired item or the like. Further, if the content 2 is exposed to a given height and then fixed in position, a separate force for fixing the content 2 is not needed, and accordingly, the content 2 is applied to a desired region more smoothly. Such an operation will be explained in detail below.

Figure 5:
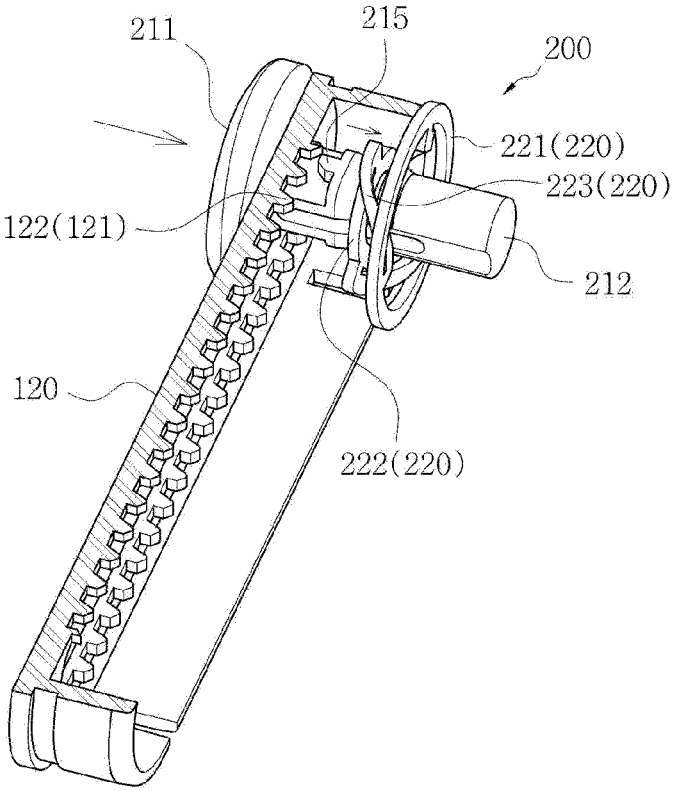
FIG. 5 is a perspective view showing a button assembly of the container according to the embodiment of the present invention, which is viewed on the rear side thereof.
Figure 6:
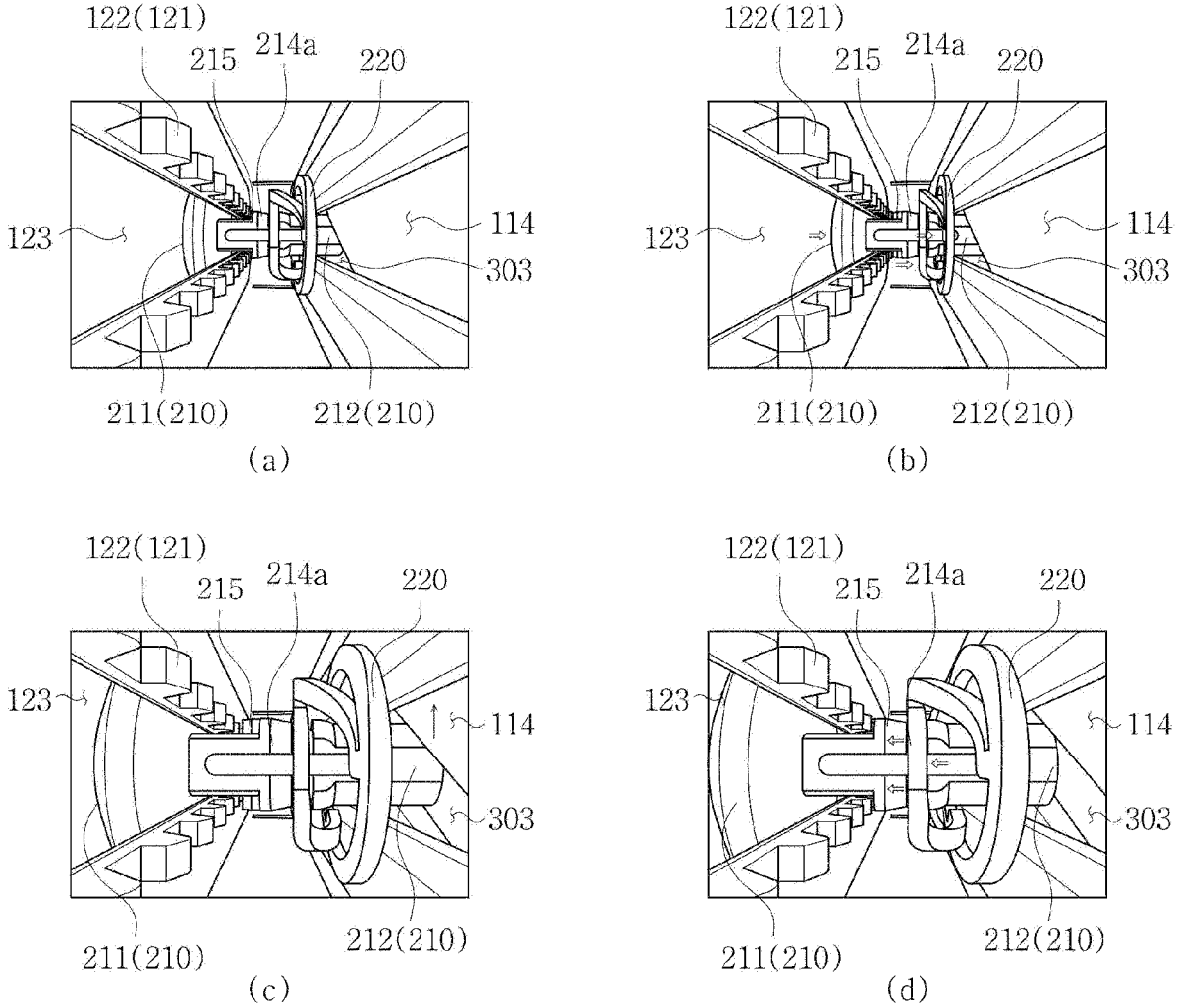
FIG. 6 is a side view showing the movements of the button assembly of the container according to the embodiment of the present invention.

FIG. 5 is a perspective view showing the button assembly 200 of the container according to the embodiment of the present invention, which is viewed on the rear side thereof. FIG. 6 is a side view showing the movements of the button assembly 200 of the container according to the embodiment of the present invention. As the position as shown in FIG. 6(*a*) is changed toward the position as shown in FIG. 6(*d*), the fixed position of the button 210 is released and thus moves to a desired position, and next, the button 210 is fixed in position again.

Now, an explanation of the limitation of the movement of the content 2 in the container 1 according to the embodiment of the present invention will be given with respect to FIGS. 5 and 6.

The button 210 is movable to a limitation position where the button 210 is fixed to the cover member 120 and thus limited in the movement in the first direction and/or to a limitation releasing position where the button 210 is allowed to move in the first direction. In this case, the limitation releasing position is located more inwardly from the outer housing assembly 100 than the limitation position. That is, if the button 210 is at the limitation position, the movement of the button 210 in the first direction is limited, and accordingly, the movement of the container 1 in the second direction is limited. Further, if the button assembly 200 is at the unused position, the content 2 cannot move to the exposed position so that it is prevented from being exposed to the outside. If the button assembly 200 is at the used position, the content 2 cannot move to the accommodated position so that a force for preventing the content 2 from moving to the accommodated position may not be applied by the user. Accordingly, the content 2 is applicable to a desired region, without the application of a separate force to the button assembly 200. If the button 210 is at the limitation releasing position, the movement of the button 210 in the first direction is allowed, and accordingly, the movement of the container 1 in the second direction is allowable. In this case, the button assembly 200 is changed in position to allow the content 2 to be located onto a desired region.

As shown in FIG. 5, the cover member 120 has a stopper 121 with a plurality of teeth 122 arranged in the extending direction of the sliding hole 123. The plurality of teeth 122 protrude from the stopper 121 toward the concaved space portion formed by the concave portion 113. The plurality of teeth 122 are equally spaced apart from one another. The button 210 further includes the stop protrusion 215 extending from the button neck 212 toward the plurality of teeth 122. While the button 210 is at the limitation position, the stop protrusion 215 is located between the neighboring teeth 122 so that it is limited in movement. That is, while the button 210 is being at the limitation position, the neighboring teeth 122 located on one side and the other side with respect to the first direction come into contact with the stop protrusion 215 to stop the movement of the stop protrusion 215, so that the movement of the button 210 stops. Contrarily, while the button 210 is at the limitation releasing position, the stop protrusion 215 is separated from the plurality of teeth 122, so that the button 210 is movable. That is, the stop protrusion 215 moves in a space among the plurality of teeth 122 in the different direction from the direction along which the plurality of teeth 122 are arranged, and even though the stop protrusion 215 moves in the first direction, the plurality of teeth 122 are not located in the first direction, so that the stop protrusion 215 is movable without any limitation. For example, as shown in FIG. 5, the button 210 is pressurized backwardly to allow the stop protrusion 215 to move backward from the plurality of teeth 122 so that the button 210 is movable from the limitation position to the limitation releasing position. The movement of the button 210 as shown in FIG. 5 corresponds to the movement of the button 210 from the position as shown in FIG. 6(*a*) to the position as shown in FIG. 6(*b*).

As mentioned above, the button assembly 200 further includes the elastic member 220 for elastically biasing the button 210 in the direction from the limitation releasing position to the limitation position. If the button 210 is at the limitation releasing position, accordingly, the button 210 is movable to the limitation position by means of the elastic member 220, without having any separate force, when the user's force applied to the button 210 is released. That is, while the button 210 is at the limitation releasing position, the button assembly 200 elastically biases the button 210 to the limitation position. As a result, the content 2 is naturally fixed in position. If the button 210 is at the limitation position, further, the elastic member 220 prevents the button 210 from moving to the limitation releasing position even though a slight external force is applied to the button 210, so that a situation where the content 2 is changed in position by means of the external force and thus applied to an undesired object does not occur.

The elastic member 220 is fixed to the button 210 to apply an elastic force to the button 210. In this case, as shown in FIG. 5, the elastic member 220 has a base part 221 fixed between the cover member 120 and the concave portion 113 in such a way as to pass the button neck 212 therethrough. Accordingly, the base part 221 is movable in the first direction according to the movement of the button assembly 200 in the first direction, but it is prevented from moving in the extending direction of the button 210. The base part 221 has the shape of a ring.

The elastic member 220 has a fixed part 222 fixed to the button neck 212 in such a way as to pass the button neck 212 therethrough. The fixed part 222 has the shape of a ring. As mentioned above, the button neck 212 has the fixing groove 213 concave inwardly therefrom to accommodate the fixed part 222. The button neck 212 passes through the fixed part 222, and the fixed part 222 is accommodated in the fixing groove 213, so that the movement of the fixed part 222 is limited by means of the first protrusion 214*a* and/or the second protrusion 214*b* (See FIG. 2). As a result, the fixed part 222 of the elastic member 220 is fixed to the button 210.

The elastic member 220 has an elastic part 223 located on the outside of the button neck 212 in such a way as to connect the base part 221 and the fixed part 222 to each other. As shown in FIG. 6, while the base part 221 is being fixed in position, the fixed part 222 moves to a direction close to the base part 221 and is supported against the elastic part 223 through the deformation of the elastic part 223, so that the movement of the button 210 from the limitation position to the limitation releasing position is performed. The deformed elastic part 223 elastically biases the fixed part 222 in a direction distant from the base part 221 so that it can be returned to its original shape. The force applied to the fixed part 222 is transferred to the button 210 so that the button 210 is elastically biased. If a distance between the fixed part 222 and the base part 221 causes the elastic part 223 to be deformable, while the button 210 is being at the limitation position, the elastic part 223 elastically biases the button 210 under the same principle as the above even when the button 210 is at the limitation position. Like this, the elastic member 220 according to the present invention is applicable to an extremely small space with the size of several millimeters (mm), and accordingly, it serves as a spring even in such a small space.

As mentioned above, the preferred embodiment of the present invention has been disclosed in the specification and drawings. In the description of the present invention, special terms are used not to limit the present invention and the scope of the present invention as defined in claims, but just to explain the present invention. Therefore, persons skilled in the relevant art can appreciate that many modifications and variations are possible in light of the above teachings. It is therefore intended that the scope of the invention be limited not by this detailed description, but rather by the claims appended hereto.

REFERENCE NUMERALS

1: Container 2: Content
100: Outer housing assembly 110: Outer housing
111: Exposure opening 112: Bottom housing
113: Concave portion 114: Guide groove
120: Cover member 121: Stopper
122: Tooth 123: Sliding hole
130: Bottom cap 200: Button assembly
210: Button 211: Button head
212: Button neck 213: Fixing groove
214*a*: First protrusion 214*b*: Second protrusion
215: Stop protrusion 220: Elastic member
221: Base part 222: Fixed part
223: Elastic part 300: Inner housing
301: Content accommodation portion
302: Inner housing neck
303: Guide groove

The invention claimed is:

1. A container comprising:
an outer housing assembly having an exposure opening formed thereon;
a button assembly coupled to the outer housing assembly and is slidingly movable in a first direction with respect to the outer housing assembly; and
an inner housing accommodated in the outer housing assembly and configured to accommodate a content therein,
wherein while the button assembly is slidingly moving, the inner housing moves in a second direction different from the first direction with respect to the outer housing assembly.

2. The container according to claim 1, wherein the button assembly is movable from an unused position to a used position in the first direction, and while the button assembly moves from the unused position to the used position, the inner housing moves in the second direction from a hidden position within the outer housing assembly towards an exposed position closer to the exposure opening than the hidden position.

3. The container according to claim 2, wherein the inner housing comprises a guide groove accommodating an end portion of the button assembly, and wherein the guide groove is slantedly defined with respect to the first direction.

4. The container according to claim 3, wherein a length of the guide groove in the second direction corresponds to a length of the inner housing in the second direction from the hidden position to the exposed position, and
wherein when the inner housing is at the exposed position, the length of the guide groove in the second direction is set to prevent an end portion of the inner housing from being exposed over the exposure opening.

5. The container according to claim 3, wherein the inner housing further comprises:
a content accommodation portion corresponding to the exposure opening; and an inner housing neck extending from the content accommodation portion and is in contact with an inner surface of the outer housing assembly.

6. The container according to claim 5, wherein the outer housing assembly comprises an outer housing having a concave portion formed concavely thereon to support the inner housing neck, and the outer housing guides a movement of the inner housing neck in the second direction.

7. The container according to claim 6, wherein the concave portion supports the content accommodation portion when the inner housing is at the hidden position.

8. The container according to claim 6, wherein the outer housing comprises a guide hole extending in the first direction, and wherein the guide hole is configured to have the button assembly inserted therein and guides the movement of the button assembly in the first direction.

9. The container according to claim 8, wherein the outer housing assembly further comprises a cover member, wherein the cover member is configured to have the button assembly inserted therein and has a sliding hole corresponding to the guide hole.

10. The container according to claim 9, wherein the button assembly comprises a button, the button comprising:

a button head exposed to an outside of the outer housing assembly; and a button neck inserted into the outer housing assembly.

11. The container according to claim 10, wherein when the button is at a limitation position, the button is fixed to the cover member of the outer housing assembly and is limited in the movement in the first direction, wherein when the button is in a limitation releasing position, the button is movable in the first direction, and wherein the limitation releasing position is located more inwardly from the outer housing assembly than the limitation position.

12. The container according to claim 11, wherein the cover member comprises a stopper having a plurality of teeth arranged in the first direction of the sliding hole, wherein the button further comprises a stop protrusion extending from the button neck toward the plurality of teeth, and wherein when the button is at the limitation position, the stop protrusion is located between a pair of neighboring teeth of the plurality of teeth to limit the movement of the button, and when the button is at the limitation releasing position, the stop protrusion is separated from the plurality of teeth and the button is movable in the first direction.

13. The container according to claim 11, wherein the button assembly further comprises an elastic member fixed to the button to elastically bias the button to the limitation position when the button is at the limitation releasing position.

14. The container according to claim 13, wherein the elastic member comprises:

a base part fixed between the cover member and the concave portion and having the button neck pass therethrough;

a fixed part fixed to the button neck and having the button neck pass therethrough; and an elastic part disposed on an outside of the button neck and configured to connect the base part and the fixed part.

15. The container according to claim 14, wherein the button neck comprises a fixing groove concaved inwardly therefrom to accommodate the fixed part of the elastic member.

16. The container according to claim 6, wherein the outer housing comprises a bottom opening formed on an opposite side to the exposure opening, and wherein the outer housing assembly further comprises a bottom cap configured to cover the bottom opening.

17. A container comprising:

an outer housing assembly comprising a sliding hole extending in a first direction and a stopper with a plurality of teeth arranged in the first direction of the sliding hole;

a button inserted into the sliding hole and is slidingly movable in the first direction with respect to the outer housing assembly, wherein the button comprises a stop protrusion extending therefrom and located between a pair of neighboring teeth of the plurality of teeth; and an inner housing accommodated in the outer housing assembly and is slidingly movable in a second direction different from the first direction when the button moves in the first direction, wherein when the button is at a limitation position where the stop protrusion is located between the pair of neighboring teeth, the button is limited in movement, and when the button is at a limitation releasing position where the stop protrusion is separated from the plurality of teeth, the button is movable in the first direction.

18. The container according to claim 17, wherein the button further comprises an elastic member fixed thereto, and when the button is at the limitation releasing position, the elastic member elastically biases the button to the limitation position.

19. The container according to claim 18, wherein the elastic member comprises:

a base part fixed to the outer housing assembly;

a fixed part fixed to the button; and an elastic part for connecting the base part and the fixed part.

* * * * *